US011608722B2

(12) United States Patent
Worm

(10) Patent No.: US 11,608,722 B2
(45) Date of Patent: Mar. 21, 2023

(54) SECTIONAL PUMPING APPARATUS FOR WELL CASE

(71) Applicant: Emil Worm, Homeland, CA (US)

(72) Inventor: Emil Worm, Homeland, CA (US)

( * ) Notice: Subject to any disclaimer, the term of this patent is extended or adjusted under 35 U.S.C. 154(b) by 0 days.

(21) Appl. No.: 17/715,808

(22) Filed: Apr. 7, 2022

(65) Prior Publication Data

US 2022/0235638 A1 Jul. 28, 2022

Related U.S. Application Data

(63) Continuation-in-part of application No. 17/339,912, filed on Jun. 4, 2021, now Pat. No. 11,480,033.

(60) Provisional application No. 63/034,828, filed on Jun. 4, 2020.

(51) Int. Cl.
*E21B 43/12* (2006.01)
*E21B 37/10* (2006.01)

(52) U.S. Cl.
CPC ..... *E21B 43/128* (2013.01); *E21B 37/10* (2013.01); *E21B 43/13* (2020.05); *E21B 43/121* (2013.01); *E21B 43/122* (2013.01); *E21B 43/123* (2013.01); *E21B 43/127* (2013.01); *E21B 43/129* (2013.01)

(58) Field of Classification Search
CPC ..... E21B 43/128; E21B 37/10; E21B 43/13; E21B 43/121; E21B 43/122; E21B 43/123; E21B 43/127; E21B 43/129; E21B 37/08; E03B 3/15
See application file for complete search history.

(56) References Cited

U.S. PATENT DOCUMENTS 598,700 A * 2/1898 Edwards ..... E21B 37/10 92/29
1,495,807 A * 5/1924 Sanders ..... E21B 43/121 92/182
1,539,229 A * 5/1925 Akeyson ..... E21B 37/10 277/342
1,603,138 A * 10/1926 Miller ..... E21B 37/10 417/511
2,221,775 A * 11/1940 Boynton ..... E21B 37/08 166/146

(Continued)

FOREIGN PATENT DOCUMENTS

KR 100979214 B1 8/2010
RU 117535 U1 6/2012

(Continued)

*Primary Examiner* — James G Sayre

(57) ABSTRACT

A sectional pumping apparatus for well casing includes a discharge pipe, a submersible pump, a pump housing, a swab tool, and a central axis. The discharge pipe, the submersible pump, the pump housing, and the swab tool are concentrically positioned along the central axis. The discharge pipe includes a first tubular body and a flange connector. The flange connector is radially connected around the first tubular body. The submersible pump is hermetically attached to a pump end of the first tubular body. The submersible pump and the pump end are positioned within the pump housing as the first tubular body is hermetically attached to a top end of the pump housing through the flange connector. The swab tool is hermetically attached to a bottom end of the pump housing and is in fluid communication with the discharge pipe through the submersible pump.

17 Claims, 9 Drawing Sheets

(56) References Cited

U.S. PATENT DOCUMENTS

| | | | | |
|---|---|---|---|---|
| 2,825,411 | A * | 3/1958 | Keltner | E21B 37/10 166/173 |
| 4,830,111 | A | 5/1989 | Jenkins | |
| 8,205,676 | B2 | 6/2012 | Nelson | |
| 10,920,516 | B2 * | 2/2021 | Parker | E21B 27/00 |
| 2003/0111226 | A1 * | 6/2003 | Dyer | E21B 37/10 166/173 |
| 2004/0089446 | A1 * | 5/2004 | Sugden | E21B 37/10 166/227 |

FOREIGN PATENT DOCUMENTS

| | | | | |
|---|---|---|---|---|
| RU | 128895 | U1 | 6/2013 | |
| WO | WO-2008073343 | A1 * | 6/2008 | E21B 37/10 |

* cited by examiner

SECTIONAL PUMPING APPARATUS FOR WELL CASE

The current application is a continuation-in-part (CIP) application of a U.S. non-provisional application Ser. No. 17/339,912 filed on Jun. 4, 2021. The U.S. non-provisional application Ser. No. 17/339,912 claims a priority to a U.S. provisional application Ser. No. 63/034,828 filed on Jun. 4, 2020.

FIELD OF THE INVENTION

The present invention generally relates to water well cleaning. More specifically, the present invention is a sectional pumping apparatus for well case to optimize the well cleaning method.

BACKGROUND OF THE INVENTION

In rural environments, much infrastructure that urban residents often take for granted does not exist. In particular, many smaller communities obtain drinking water solely from underground aquifers. As a result, in all rural environments, water wells are a necessity. Because of that, water well cleaning methods and devices are in demand as the water well cleaning process is a vital part to keep a water system sanitary, healthful, and in good condition. More specifically, the openings in a well casing provide passageways for the flow of water. Over time, the openings tend to become plugged with sand, the products of corrosion, sediment deposits, and other inorganic or organic complexes. As a result, these materials begin to cake and clog the openings in the well casing or screen thus reducing the pump efficiency and intake of water while increasing the pumping head and the pumping cost.

A common accepted industry standard for removing debris from water wells is the "swab and airlift technique," in which agitation is achieved through the vertical movement of a swab tool making a plunging action, with airlifting accomplished by using compressed air to remove the debris from the well. However, the airlifting action requires 100-200 feet of airline submergence below the well's static water level and does not provide a continuous flow (i.e., a constant flow velocity). Swab and airlift techniques also have physical limitations: their flow velocities are less controlled and their water movement is not continuous. Mechanical limitations of the swab and airlift technique include the maximum number of strokes applied within the developed zone (i.e., agitation). The swab tool and airline are affixed to the pump rig's mast, allowing 20-30 strokes within a 5-foot zone per minute. Areas of the well structures that lack the necessary submergence and/or have low-yielding aquifers may be limited to redevelopment with the swab and airlift technique. These factors may lead to increased costs and unsatisfactory results (i.e., high sand/sediment production and low flow rates).

Companies have attempted to develop various methods for cleaning plugged openings though various remedial operations such as chemical treatments, mechanical techniques (e.g., brushing and bailing), use of a high-pressure air gun to create a hydraulic wave, the use of jetted streams of liquid, reperforation of the casing, and so forth. However, most such cleaning methods are ineffective. Accordingly, there is a need to develop a method or system that improves on existing methods while solving such problems.

It is therefore an objective of the present invention to provide a sectional pumping apparatus for a well case to improve upon the conventional well cleaning methods while incorporating other problem-solving features. The present invention is a pumping system with a swabbing tool so a specific section of the well case can be cleaned and pumped. The present invention is utilized to pump out a well case before chemical injection, after chemical injection, and mechanical development stages of the well rehabbing process to improve upon the existing well cleaning method.

DETAIL DESCRIPTIONS OF THE INVENTION

All illustrations of the drawings are for the purpose of describing selected versions of the present invention and are not intended to limit the scope of the present invention.

The present invention is a sectional pumping apparatus for well casing that is used during a well remediation process. Generally, volume of water and sediment buildup are removed through the well face (opening) of the well by a swab and airlift technique during a well remediation process. The present invention provides an alternative method so that the volume of water and sediment buildup can be efficiently and effectively removed in comparison to the traditional swab and airlift technique. The well drilling rig moves the present invention up and down within the well casing and maintains a specific distance throughout the up and down motion. The present invention is then able to fully remove sediment buildup and volume of water within the corresponding specific distance. As a result, the present invention is utilized to remove a volume of water and sediment buildup before chemical injection, after chemical injection, and mechanical development stages of the well remediation process to improve upon the existing well cleaning method.

Figure 1:
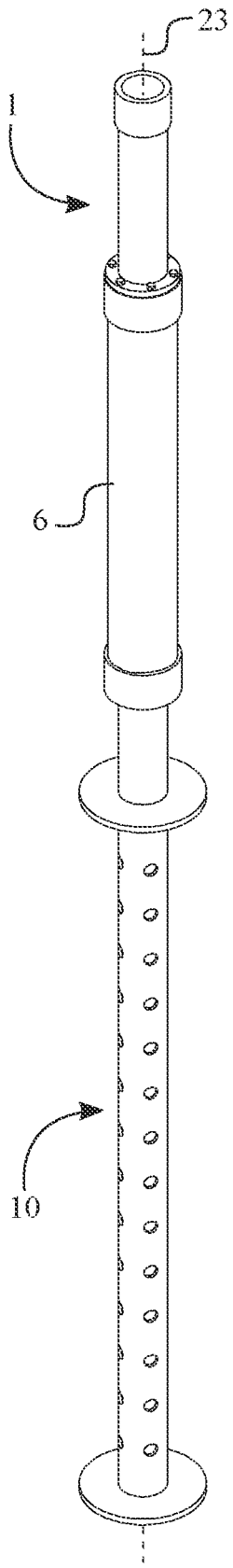
FIG. 1 is a perspective view of the present invention.
Figure 2:
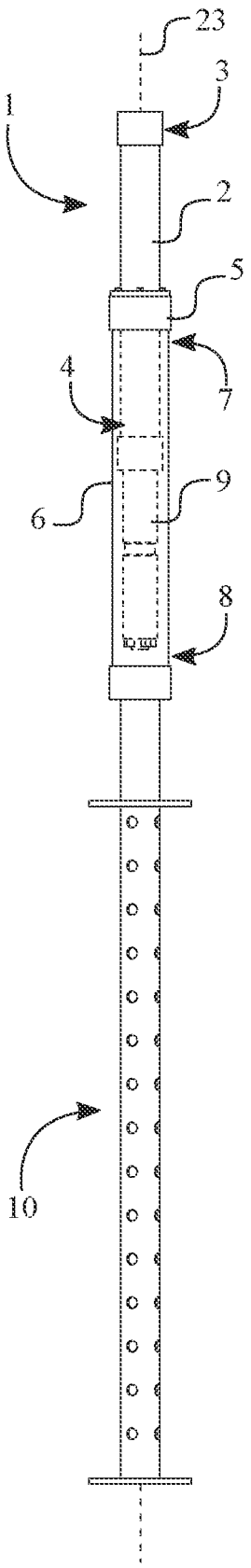
FIG. 2 is a side view of the present invention showing the internal positioning of the submersible pump and the pump end of the first tubular body.
Figure 3:
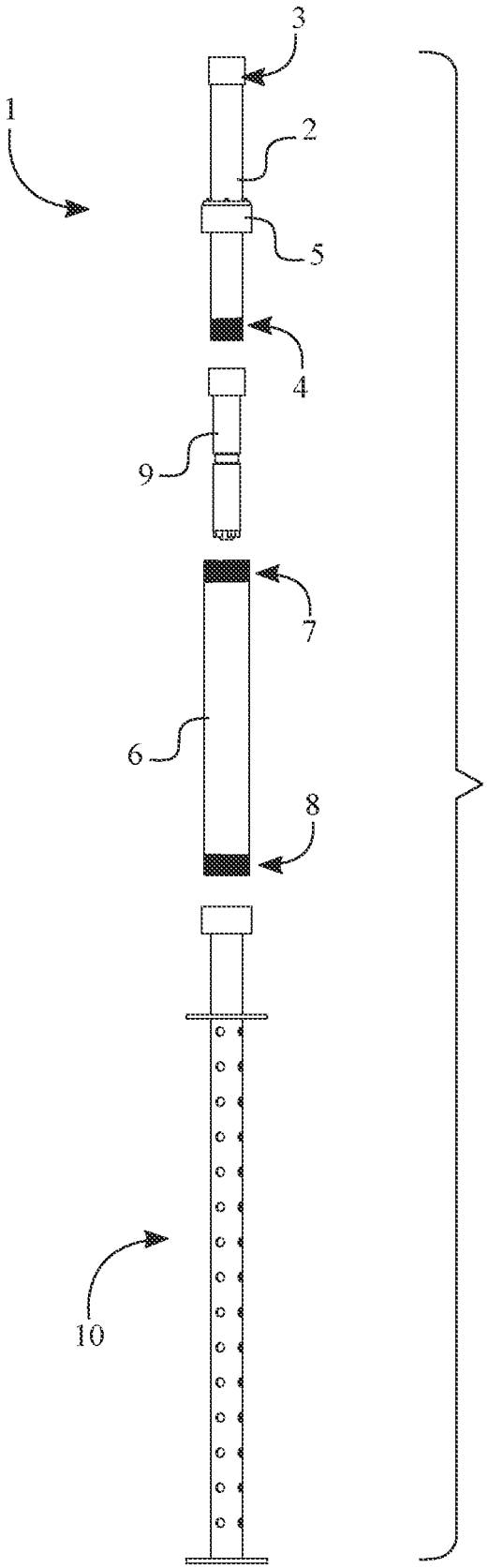
FIG. 3 is an exploded view of the present invention.

The present invention comprises a discharge pipe 1, a submersible pump 9, a pump housing 6, a swab tool 10, and a central axis 23 as shown in FIG. 1-3. In reference to the general configuration of the present invention, the discharge pipe 1, the submersible pump 9, the pump housing 6, and the swab tool 10 are concentrically positioned along the central axis 23 thus forming linear configuration for each of the components. The discharge pipe 1 functions as the outlet of the present invention so that the water and sediment can be discharged. The discharge pipe 1 comprises a first tubular body 2 and a flange connector 5, wherein the flange connector 5 is radially connected around the first tubular body 2. The submersible pump 9 is hermetically attached to a pump end 4 of the first tubular body 2 so that the water and sediment can be mechanically pumped out from the well casing. The submersible pump 9 and the pump end 4 are positioned within the pump housing 6 as the first tubular body 2 is hermetically attached to a top end 7 of the pump housing 6 through the flange connector 5. As a result, the pump housing 6 is able to enclose and protect the submersible pump 9. The swab tool 10 is hermetically attached to a bottom end 8 of the pump housing 6 so that the well casing can be cleaned with the up and down motion of the well drilling rig. The swab tool 10 is in fluid communication with the discharge pipe 1 through the submersible pump 9 so that the present invention is able to remove volume of water and sediments during the well remediation process.

Figure 4:
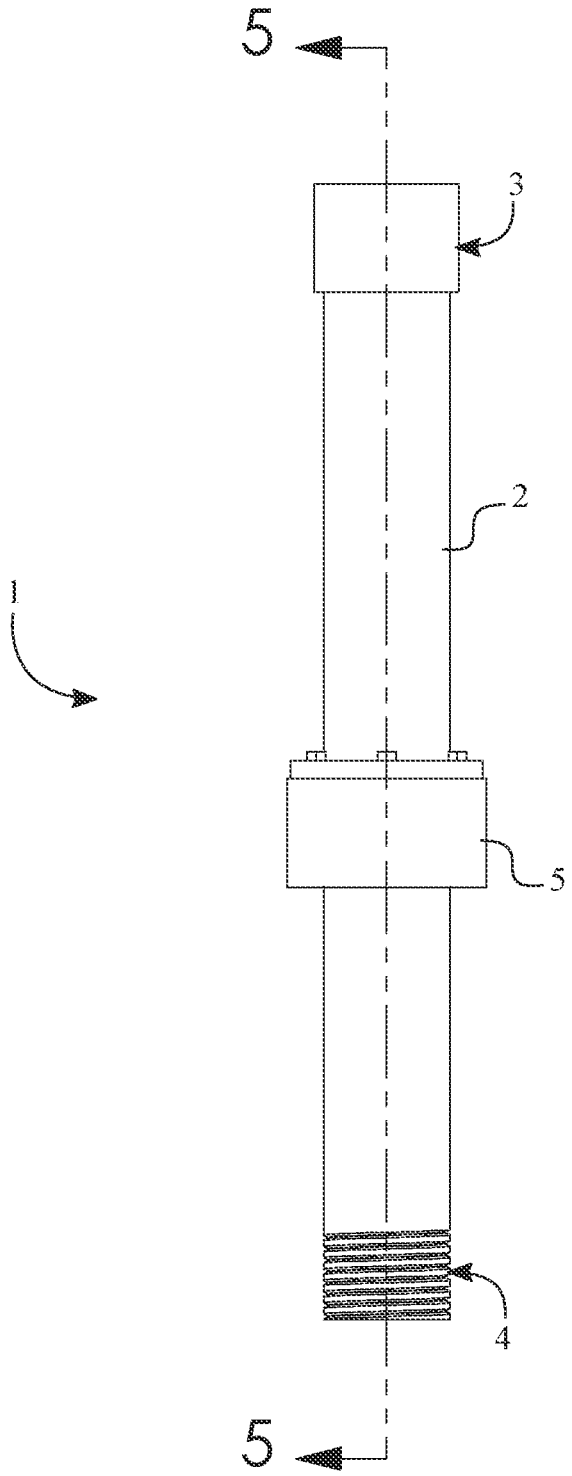
FIG. 4 is a front view of discharge pipe of the present invention, showing the plane upon which a cross sectional view is taken shown in FIG. 5.
Figure 5:
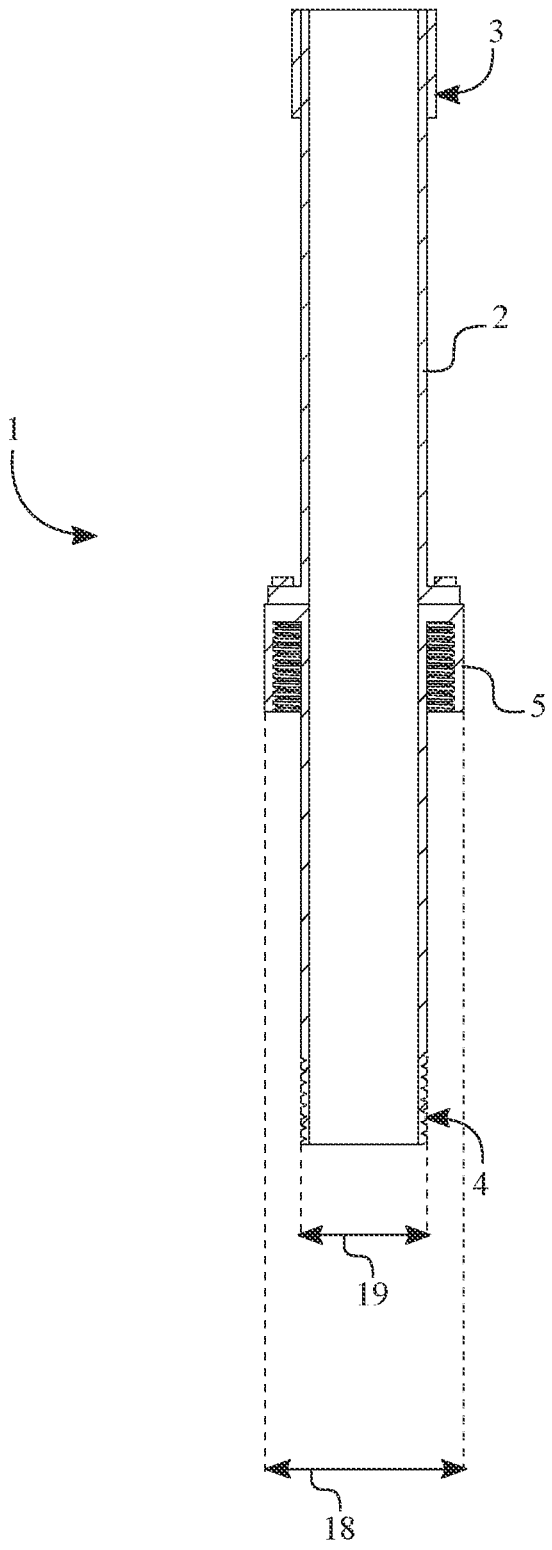
FIG. 5 is a cross section view of discharge pipe of the present invention taken along line 5-5 of FIG. 4.

In reference to FIG. 4-5, the first tubular body 2 further comprises a pipe end 3 in addition to the pump end 4. The pipe end 3 and the pump end 4 are oppositely positioned of each other about the first tubular body 2. In other words, the first tubular body 2 is linearly extended from the pipe end 3 to the pump end 4. The flange connector 5 is positioned in between the pipe end 3 and the pump end 4 so that the first tubular body 2 can be mounted to the pump housing 6. Furthermore, a first diameter 18 of the flange connector 5 is greater than a second diameter 19 of the first tubular body 2 thus allowing the flange connector 5 to externally mount around the top end 7 of the pump housing 6. More specifically, the flange connector 5 externally threads around the top end 7 of the pump housing 6 in order to create the hermetic connection. As a result of the positioning of the flange connector 5 with respect to the pipe end 3 and the pump end 4, the first tubular body 2 from the flange connector 5 to the pipe end 3 is externally positioned to the pump housing 6. The first tubular body 2 from the flange connector 5 to the pump end 4 is internally positioned within the pump housing 6.

In reference to FIG. 4-5, the pipe end 3 is configured to receive a plurality of extension pipes so that the present invention can be lowered to a desired depth within the well casing. In other words, each of the plurality of extension pipes is linearly attached to each other via a threaded connection so that the present invention can be lowered to the desired depth. The pump end 4 is configured to receive the submersible pump 9 so that the water and sediment from the wall casing can be distributed into the discharge pipe 1.

In reference to FIG. 2-3, the submersible pump 9 is industry standard well pump so that the water and sediment can be pumped out of the well casing. The submersible pump 9 preferably comprises a pump assembly and a motor assembly, wherein the pump assembly is operatively coupled to the motor assembly. More specifically, the pump assembly is in fluid communication with the pump end 4 so that the water and sediment can be discharged into the first tubular body 2 as the motor assembly operates the pump assembly.

In reference to FIG. 2-3, the pump housing 6 is also a tubular structure that linearly extends from the top end 7 to the bottom end 8. Furthermore, a diameter of the pump housing 6 is greater than the second diameter 19 so that the first tubular body 2 can be inserted. Furthermore, the first diameter 18 is larger than the diameter of the pump housing 6 so that flange connector 5 can be externally mounted.

Figure 9:
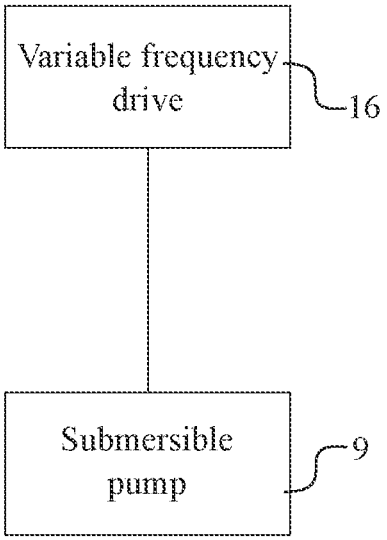
FIG. 9 is a basic schematic showing the electrical connection of the present invention.

In reference to FIG. 9, the present invention further comprises a variable frequency drive 16 to power the submersible pump 9. More specifically, the variable frequency drive 16 positioned on the ground level and is electrically connected with the submersible pump 9 via an electrical power cable. As a result, the variable frequency drive 16 is able to electrically power the submersible pump 9 within the present invention.

Figure 6:
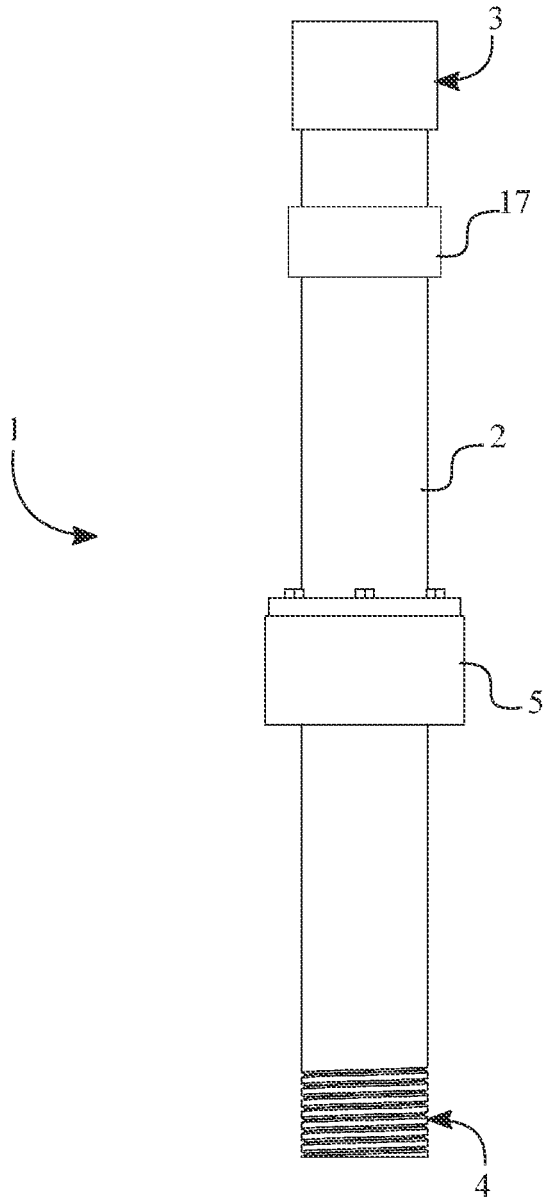
FIG. 6 is a side view of the discharge pipe of the present invention with the check valve.

In reference to FIG. 6, the present invention further comprises a check valve 17. Depending upon different well remediation process, the check valve 17 may or may not be utilized within the present invention. the check valve 17 prevents dispersing dirty material throughout the entire length of the column area. More specifically, the check valve 17 is concentrically positioned in between the pipe end 3 of the first tubular body 2 and the flange connector 5 and is in fluid communication with the first tubular body 2 so that the discharged dirty material does not return back to the well casing.

Figure 7:
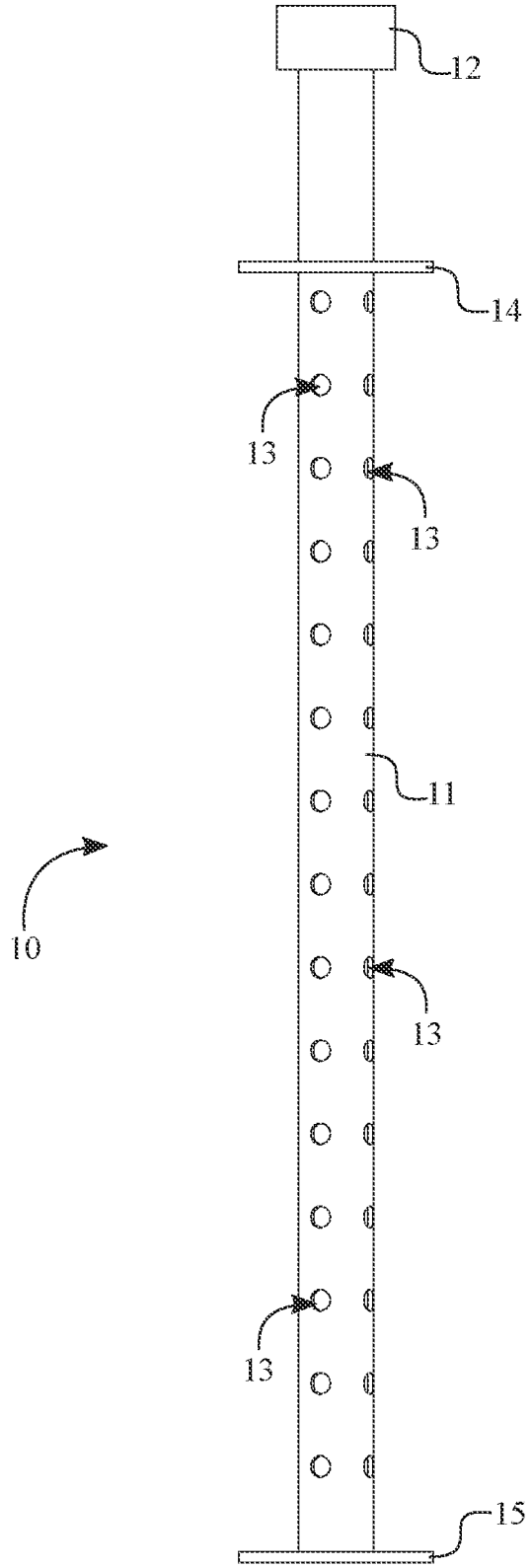
FIG. 7 is a side view of the swab tool of the present invention.
Figure 8:
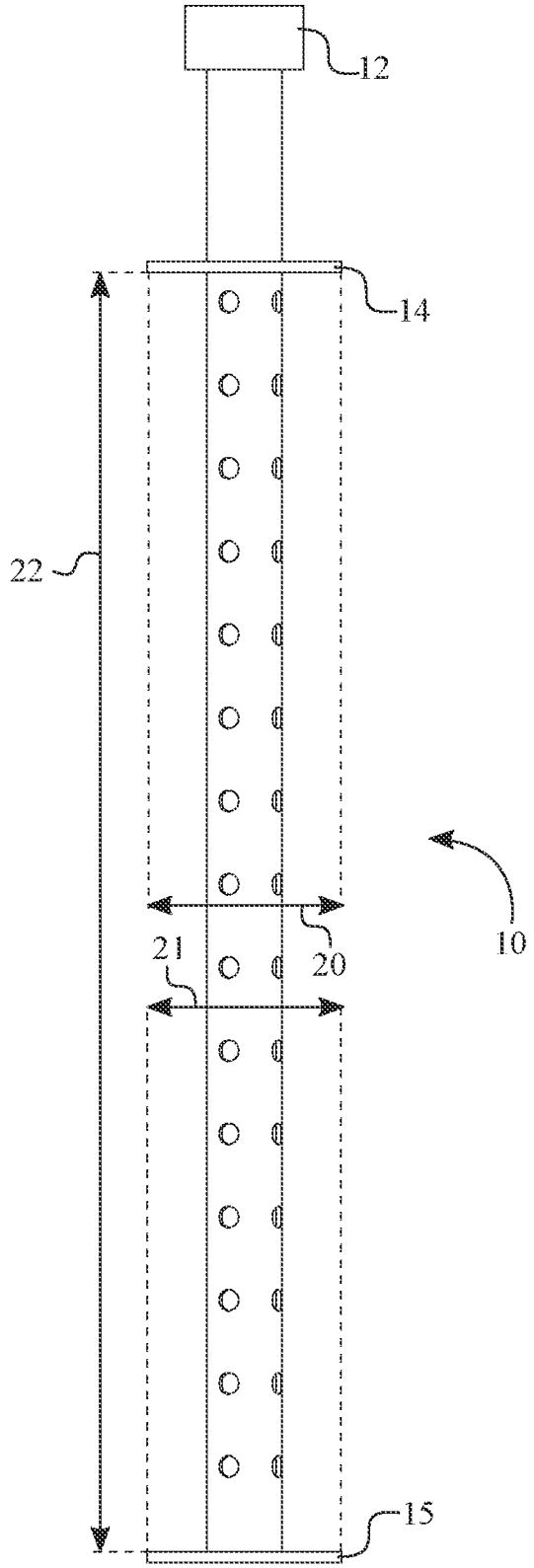
FIG. 8 is a side view of the swab tool of the present invention showing the diameters of the upper flexible disk and the lower flexible disk.

In reference to FIG. 7-8, the swab tool 10 that cleans the well casing comprises a second tubular body 11, a tool coupler 12, a plurality of openings 13, an upper flexible disk 14, and a lower flexible disk 15. More specifically, the tool coupler 12 and the lower flexible disk 15 are oppositely positioned of each other about the second tubular body 11 thus delineating the two terminal ends. The tool coupler 12 is radially connected to the second tubular body 11 so that the tool coupler 12 can threadedly attach to the bottom end 8 of the pump housing 6. The lower flexible disk 15 is radially connected around the second tubular body 11 thus defining the lowest component of the present invention. The upper flexible disk 14 is radially connected around the second tubular body 11 and positioned in between the lower flexible disk 15 and the tool coupler 12. More specifically, when the swab tool 10 is inserted into the well casing, the lower flexible disk 15 and the upper flexible disk 14 are able to press against the well casing and trap water and sediments within. As a result, when the well drilling rig moves the present invention up and down, the swab tool 10 only disrupts water and sediment that are trapped within the lower flexible disk 15 and the upper flexible disk 14. Furthermore, a third diameter 20 of the upper flexible disk 14 is equal to a fourth diameter 21 of the lower flexible disk 15 to ensure water and sediment that are trapped within the lower flexible disk 15 and the upper flexible disk 14 do not escape back into the well casing. The plurality of openings 13 radially traverses into the second tubular body 11 and positioned in between the lower flexible disk 15 and the upper flexible disk 14. Resultantly, operation of submersible pump 9 is able to pull water and sediment that are disrupted within the lower flexible disk 15 and the upper flexible disk 14 into the pump housing 6 via the plurality of openings 13.

Preferably, a distance 22 between the upper flexible disk 14 and the lower flexible disk 15 is 10 feet. However, the distance 22 between the upper flexible disk 14 and the lower flexible disk 15 is not limited to 10 feet and can differ upon specification of the well casing, industry standards, or the configurations of the present invention.

In order to implement the well remediation process, the present invention is used in conjunction with a well case brushing and surge blocking apparatus that is used to brush a well casing or surge well. A rotating arm action of the well case brushing and surge blocking apparatus can force volumes of water at high velocity through the screen area of the well thus removing extra drill mud, sand, and chemical residue through the well face (opening) of the well. Due to the component configuration, the well case brushing and surge blocking apparatus is able to achieve about 120 feet per minute with a 5-foot tool and a 6-foot stroke from the rotating arm. Depending upon different steps of the well remediation process, the 5-foot tool can be a cleaning tool or a surge blocking tool. Aforementioned result provide a greater improvement over traditional output of a swab tool and airline of the pump rig's mast that allowing 20-30 strokes within a 5-foot zone per minute.

The well case brushing and surge blocking apparatus comprises a housing, a frame, an actuating arm, a gear assembly, a hydraulic motor, a hydraulic speed controller, and a hydraulic counterbalance. In reference to the general configuration of the well case brushing and surge blocking apparatus, the housing is laterally connected to the frame so that the housing can be mounted to the rig via the frame. The actuating arm is positioned within the housing, wherein the housing functions as a protective casing for the actuating arm. The actuating arm functions as the rotating arm so that the sand line of rig can be looped through the well case brushing and surge blocking apparatus. The gear assembly is laterally mounted to the frame, opposite of the housing to provide optimal gear ration between the actuating arm and the hydraulic motor. More specifically, a stator of the hydraulic motor is externally mounted to the gear assembly so that a rotor of the hydraulic motor and the actuating arm are able to torsionally couple with each other via the gear assembly. The hydraulic speed controller is mounted to the frame to control the rotational speed of the hydraulic motor. The hydraulic counterbalance is mounted to the frame so that the surging speed of the well case brushing and surge blocking apparatus can be controlled without compromising the structural integrity of the well case brushing and surge blocking apparatus. The hydraulic motor is in fluid communication with the hydraulic speed controller and the hydraulic counterbalance in order to power the well case brushing and surge blocking apparatus with a hydraulic pump system of the rig.

The housing that functions a protective casing for the actuating arm comprises a first perforated panel, a second perforated panel, a lateral panel, a wire-rope opening, an upper sheave, and a lower sheave. More specifically, the first perforated panel is perimetrically connected around the lateral panel. The second perforated panel is perimetrically connected around the lateral panel, opposite of the first perforated panel. As a result, the first perforated panel, the second perforated panel, the lateral panel are able to delineate a casing for the actuating arm. Preferably, the first perforated panel and the second perforated panel are made from expansion metal panels so that the rotation of the actuating arm can be visible for inspection purposes. The wire-rope opening centrally traverses into the housing through the lateral panel to provide an opening so that the sand line of rig can be engaged with the actuating arm. In order to minimize the friction between the sand line and the housing during the operation of the well case brushing and surge blocking apparatus, the upper sheave is rotatably connected to the lateral panel, and the lower sheave is rotatably connected to the lateral panel. The upper sheave and the lower sheave are centrally positioned within the wire-rope opening so that a rig end of the sand line can be engaged around the upper sheave, and a free end of the sand line can be engaged around the lower sheave. Furthermore, the upper sheave is linearly positioned to the lower sheave thus allowing the sand line to vertically moves in the upward direction and the downward direction. In other words, the upper sheave and the lower sheave are positioned perpendicular to a transverse plane of the housing.

The frame is a structural body and functions as a platform thus allowing the rest of the components of the well case brushing and surge blocking apparatus to be secured. Preferably, the frame is a skeletal structure and formed into rectangular shape so that the well case brushing and surge blocking apparatus can be outwardly hung from the back end of the rig. The first perforated panel is adjacently connected to the frame so that the housing can be laterally connected to the frame. Furthermore, the upper sheave and the lower sheave are positioned adjacent to a free end of the frame so that the sand line can vertically moves in the upward direction and the downward direction, away from the back end of the rig.

The well case brushing and surge blocking apparatus further comprises at least one trailer mount. The at least one trailer mount is terminally connected to the frame so that the frame can be mounted to the back of the rig. More specifically, the at least one trailer mount is positioned adjacent to a mounting end of the frame as the free end and the mounting end are positioned opposite of each other about the frame. The well case brushing and surge blocking apparatus preferably uses a pair of straight tongue trailer couplers as the at least one trailer mount. However, the at least one trailer mount is not limited to the pair of straight tongue trailer couplers can be any other types of quick detaching coupling systems that can withstand the weight and movement of the well case brushing and surge blocking apparatus.

The actuating arm is configured to provide a specific vertical displacement of the tool (a cleaning tool or a surge blocking tool) that is attached to the free end of the sand line. The actuating arm comprises a proximal section, a distal section, an elongated section, and a middle sheave. The proximal section is terminally connected to the elongated section delineating an end of the actuating arm. The distal section is terminally connected to the elongated section, opposite of the proximal section, delineating an opposite end of the actuating arm. The proximal section is torsionally engaged with the gear assembly so that the rotational force of the hydraulic motor can be transferred into the actuating arm. When the hydraulic motor is powered through the hydraulic pump system, the stator of the hydraulic motor rotates an input gear/shaft of the gear assembly thus allowing the actuating arm to be rotates about a first rotational axis of an output gear/shaft of the gear assembly. The middle sheave is rotatably mounted to the distal section as the upper sheave, the lower sheave, and the middle sheave are positioned coplanar to each other. More specifically, the middle sheave rotates about the first rotational axis due to the radial movement of the actuating arm and also about a second rotational axis that concentrically traverses through the middle sheave. The middle sheave provides a radial surface area so that the sand line can be looped around the middle sheave.

In reference to the engagement of the sand line with the well case brushing and surge blocking apparatus, the free end of the sand line is first engaged around the upper sheave and inserted into the housing so that the free end of the sand line can be looped around the middle shave. Then, the free end of the sand line is engaged around the lower sheave and placed outside of the housing. The tool (a cleaning tool or a surge blocking tool) can then be attached to the free end of the sand line. In order to attain the specific vertical displacement of the tool, the rig end of the sand line maintains a stationary position with respect to the rig. When the actuating arm rotates about the first rotational axis, the sand line that is looped around the middle sheave radially travels around the first rotational axis also. As a result, the free end of the sand line vertically moves upwards and downward thus providing the specific vertical displacement for the tool. For example, when the middle shave is positioned adjacent to the upper sheave and the lower sheave or the free end of the frame, the tool is positioned at a maximum depth of the vertical displacement as a shorter section of the sand line is looped around the middle sheave. When the middle shave is positioned adjacent to the mounting end of the frame, the tool is positioned at a minimum depth of the vertical displacement as a larger section of the sand line is looped around the middle sheave.

The hydraulic speed controller comprises a controller body, a regulator handle, an inlet valve, and an outlet valve. The controller body is mounted to the frame and easily accessible to the user for repairs and maintenance. The regulator handle is integrated into the controller body as the rotational speed of the hydraulic motor is controlled through the regulator handle. The inlet valve is integrated into the controller body so that a supply line of the hydraulic pump system can be in fluid communication with the well case brushing and surge blocking apparatus. As a result, a pressured hydraulic flow from the hydraulic pump system can be discharged into the controller body via the inlet valve. The outlet valve is integrated into the controller body so that a return line of the hydraulic pump system can be in fluid communication with the well case brushing and surge blocking apparatus. As a result, a non-pressured hydraulic flow from the controller body can be discharged into the hydraulic pump system via the outlet valve.

The hydraulic counterbalance is utilized within the well case brushing and surge blocking apparatus to safely hold suspended loads and deal with over-running loads. As a result, the well case brushing and surge blocking apparatus is able to maintain constant velocity for the upward direction and the downward direction of the sand line and the tool. The hydraulic counterbalance is positioned adjacent to the hydraulic speed controller. Furthermore, the hydraulic counterbalance is mounted to the frame and easily accessible to the user for repairs and maintenance.

The well case brushing and surge blocking apparatus can further comprise a secondary securing mechanism that provides additional protection for the attachment between the rig and the frame. More specifically, the secondary securing mechanism functions as a backup mounting system for the well case brushing and surge blocking apparatus to compensate any random failures of the at least one trailer mount.

As the $1^{st}$ step of the well remediation process, all possible correspondence regarding the well, including the well log, maintenance records, and records of previous testing (e.g., e-logs, spinner tests) are collected by the operator.

As the $2^{nd}$ step, all equipment of the well is removed and each piece of equipment is then evaluated for wear and tear by the operator.

After the inspection of the equipment, a first video log is conducted as the third step via an underwater camera. During the first video log, operator records the well depth, evaluates the casing for any damage, including holes, ruptured welds, and additional pieces of equipment abandoned from prior work. If additional equipment or any other debris is found in the well, it should be removed to complete the $3^{rd}$ step.

As the $4^{th}$ step, entire well casing and screen interval are brushed through the well case brushing and surge blocking apparatus. Optionally, the operator can also perform another video log via the underwater camera to inspect holes in the well casing after the $4^{th}$ step is completed. The actuating arm of the well case brushing and surge blocking apparatus can force volumes of water at high velocity through the screen area and into the well face, removing extra drill mud, sand, and chemical residue to dramatically increase the output of the well.

As the $5^{th}$ step, the operator performs a first pass of the present invention so that the well casing can be prepped for chemical injection. The present invention is much more efficient rather than traditional an air compressor to produce high-velocity controlled water flow to get any loose materials out from behind the screen interval to better assure the displacing of the chemicals on injection. For example, the present invention's constant flow velocities can range from 350 to 750 gallons per minute (gpm), compared with the conventional swab and airlift technique's maximum rate of 300 gpm. The variable-frequency drive 16 (VFD) can be used to maintain water levels and control flow velocities of the well structure being developed regardless of the well's condition. If flow velocities exceed the aquifer's yield, a loss of suction feature shuts the present invention, terminating the flow velocity, allowing the operator to adjust the flow and protect the well structure being developed.

As the $6^{th}$ step, various types of chemicals are injected into the well casing. If an overabundance of driller's mud was used to set the well face before the casing was installed, special liquid clay dispersants can be used to break down and thin the driller's mud. Living and dead bacteria can attach to the casing, screen areas, and well face, reducing and sometimes even stopping the flow of water into the well. Special NSF (National Sanitation Foundation) approved chemicals can be used to kill the bacteria and dislodge the calcium carbonate from the different well surfaces.

As the $7^{th}$ step, the well case brushing and surge blocking apparatus is utilized to surge block of chemical at a rate of 12 strokes per minute with a six foot stroke and ten foot surge blocking tool.

As the $8^{th}$ step, chemical extraction is completed through the present invention in such a way that the pumping is completed at a rate of no less than 200 gallons per minute (well permitted on flow rate) until PH level is above 6.5.

As the $9^{th}$ step, mechanical development is completed through the present invention in such a way that the pumping is completed at a rate of no less than 200 gallons per minute (well permitted on flow rate) through entire well screen until turbidity levels are less than 2 parts per million (PPM).

As $10^{th}$ step, well sump clean out with check valve is installed above the present invention, preventing the disturbed water column from reentering the well casing (i.e., at a loss of suction feature). In appropriate conditions, the operator may remove the check valve 17, allowing the water column to reenter the well structure, providing a focused surging action for the area being developed.

In reference to steps 8-10, in one embodiment, the present invention can be placed above an adjustable length of a stinger, where the stinger is a smaller-diameter pipe with the swab tool affixed to the bottom. The adjustable length of the stinger may be dependent on the total dynamic head of the present invention. This removes the limitations of the submergence requirement while providing controlled flow velocities with minimal submergence. Thus, the present invention can be used to improve and accelerate debris or residue removal.

In reference to steps 8-10, in one embodiment, the present invention can be lowered near the debris level and a pipe extended from the bottom of the pump to suck up the debris much more rapidly, saving time and reducing costs. The constant flow velocity can be used in a controlled manner, allowing flow rates to be dialed in for any condition (e.g., low-yielding aquifers). The benefit of the present invention is that it provides the vacuum-tight seal needed to create positive suction that displaces the development water through the swab tool with high-velocity constant flow.

As the $11^{th}$ step, pump development is performed through pumping and surging to conduct the step test, constant flow rate test, and a post rehabilitation video log. The post rehabilitation video log is performed to identify any changes and inspect repairs made.

As the $12^{th}$ step, the well case brushing and surge blocking apparatus is utilized to perform a well disinfection by surge blocking sodium hypochlorite throughout entire wetted well casing.

As the $13^{th}$ step, the operator conducts an updating process to provide all updating of the initial, including any new equipment if required. All equipment is then set back into the well.

Although the invention has been explained in relation to its preferred embodiment, it is to be understood that many other possible modifications and variations can be made without departing from the spirit and scope of the invention as hereinafter claimed.

What is claimed is:

1. A sectional pumping apparatus for well casing comprising:

a discharge pipe;

a submersible pump;

a pump housing;

a swab tool;

a central axis;

the discharge pipe, the submersible pump, the pump housing, and the swab tool being concentrically positioned along the central axis;

the discharge pipe comprising a first tubular body and a flange connector;

the flange connector being radially connected around the first tubular body;

the submersible pump being hermetically attached to a pump end of the first tubular body;

the submersible pump and the pump end being positioned within the pump housing;

the first tubular body being hermetically attached to a top end of the pump housing through the flange connector;

the swab tool being hermetically attached to a bottom end of the pump housing; and the swab tool being in fluid communication with the discharge pipe through the submersible pump.

2. The sectional pumping apparatus for well casing as claimed in claim 1 comprising:

the first tubular body further comprising a pipe end;

the pipe end and the pump end being oppositely positioned of each other about the first tubular body; and the flange connector being positioned in between the pipe end and the pump end.

3. The sectional pumping apparatus for well casing as claimed in claim 2, wherein the pipe end is externally positioned to the pump housing.

4. The sectional pumping apparatus for well casing as claimed in claim 2, wherein a first diameter of the flange connector is greater than a second diameter of the first tubular body.

5. The sectional pumping apparatus for well casing as claimed in claim 1 comprising:

a check valve;

the check valve being concentrically positioned in between a pipe end of the first tubular body and the flange connector; and the check valve being in fluid communication with the first tubular body.

6. The sectional pumping apparatus for well casing as claimed in claim 1 comprising:

a variable frequency drive; and the variable frequency drive being electrically connected to the submersible pump.

7. The sectional pumping apparatus for well casing as claimed in claim 1 comprising:

the swab tool comprising a second tubular body, a tool coupler, a plurality of openings, an upper flexible disk, and a lower flexible disk;

the tool coupler and the lower flexible disk being oppositely positioned of each other about the second tubular body;

the tool coupler being radially connected to the second tubular body;

the tool coupler being threadedly attached to the bottom end of the pump housing;

the lower flexible disk being radially connected around the second tubular body;

the upper flexible disk being radially connected around the second tubular body;

the upper flexible disk being positioned in between the lower flexible disk and the tool coupler;

the plurality of openings radially traversing into the second tubular body; and the plurality of openings being positioned in between the lower flexible disk and the upper flexible disk.

8. The sectional pumping apparatus for well casing as claimed in claim 7, wherein a distance between the upper flexible disk and the lower flexible disk is 10 feet.

9. The sectional pumping apparatus for well casing as claimed in claim 7, wherein a third diameter of the upper flexible disk is equal to a fourth diameter of the lower flexible disk.

10. A sectional pumping apparatus for well casing comprising:

a discharge pipe;

a submersible pump;

a pump housing;

a swab tool;

a central axis;

a variable frequency drive;

the discharge pipe, the submersible pump, the pump housing, and the swab tool being concentrically positioned along the central axis;

the discharge pipe comprising a first tubular body and a flange connector;

the flange connector being radially connected around the first tubular body;

the submersible pump being hermetically attached to a pump end of the first tubular body;

the submersible pump and the pump end being positioned within the pump housing;

the first tubular body being hermetically attached to a top end of the pump housing through the flange connector;

the swab tool being hermetically attached to a bottom end of the pump housing;

the swab tool being in fluid communication with the discharge pipe through the submersible pump; and the variable frequency drive being electrically connected to the submersible pump.

11. The sectional pumping apparatus for well casing as claimed in claim 10 comprising:

the first tubular body further comprising a pipe end;

the pipe end and the pump end being oppositely positioned of each other about the first tubular body; and the flange connector being positioned in between the pipe end and the pump end.

12. The sectional pumping apparatus for well casing as claimed in claim 11, wherein the pipe end is externally positioned to the pump housing.

13. The sectional pumping apparatus for well casing as claimed in claim 11, wherein a first diameter of the flange connector is greater than a second diameter of the first tubular body.

14. The sectional pumping apparatus for well casing as claimed in claim 10 comprising:

a check valve;

the check valve being concentrically positioned in between a pipe end of the first tubular body and the flange connector; and the check valve being in fluid communication with the first tubular body.

15. The sectional pumping apparatus for well casing as claimed in claim 10 comprising:

the swab tool comprising a second tubular body, a tool coupler, a plurality of openings, an upper flexible disk, and a lower flexible disk;

the tool coupler and the lower flexible disk being oppositely positioned of each other about the second tubular body;

the tool coupler being radially connected to the second tubular body;

the tool coupler being threadedly attached to the bottom end of the pump housing;

the lower flexible disk being radially connected around the second tubular body;

the upper flexible disk being radially connected around the second tubular body;

the upper flexible disk being positioned in between the lower flexible disk and the tool coupler;

the plurality of openings radially traversing into the second tubular body; and the plurality of openings being positioned in between the lower flexible disk and the upper flexible disk.

16. The sectional pumping apparatus for well casing as claimed in claim 15, wherein a distance between the upper flexible disk and the lower flexible disk is 10 feet.

17. The sectional pumping apparatus for well casing as claimed in claim 15, wherein a third diameter of the upper flexible disk is equal to a fourth diameter of the lower flexible disk.

* * * * *